US006112852A

United States Patent [19]

D'Antonio et al.

[11] Patent Number: 6,112,852

[45] Date of Patent: Sep. 5, 2000

[54] ACOUSTICAL TREATMENTS WITH DIFFUSIVE AND ABSORPTIVE PROPERTIES AND PROCESS OF DESIGN

[75] Inventors: Peter D'Antonio, Upper Marlboro, Md.; Trevor J. Cox, Chorlton, United Kingdom

[73] Assignee: RPG Diffusor Systems, Inc., Upper Marlboro, Md.

[21] Appl. No.: 09/400,979

[22] Filed: Sep. 22, 1999

[51] Int. Cl.[7] ..... E04B 1/82

[52] U.S. Cl. ..... 181/295; 181/30

[58] Field of Search ..... 181/286, 288, 181/292, 293, 294, 295, 30

[56] References Cited

U.S. PATENT DOCUMENTS 5,817,992 10/1998 D'Antonio ..... 181/295

*Primary Examiner*—Khanh Dang
*Attorney, Agent, or Firm*—H. Jay Spiegel

[57] ABSTRACT

An appropriate binary sequence is used to create an acoustical treatment surface having desired parts with reflective properties and desired parts having absorptive properties resulting in the net effect of partially diffusive, partially absorptive properties. A genetic algorithm is designed to search for optimal 1D and 2D configurations for the acoustical treatments. A genetic algorithm essentially mimics the process of evolution that occurs in biology and is a known mathematical technique. During the course of genetic optimization, the fitness of individual sequences for the desired purposes is calculated. A useful fitness function includes terms that optimize the desired percentage of reflectivity and absorptivity. Through use of genetically optimized binary sequences, a curved surface may be constructed and optimized to find the best shape to achieve even scattering. The curved surface produces a dramatic improvement in effectiveness of diffusion.

26 Claims, 11 Drawing Sheets

ACOUSTICAL TREATMENTS WITH DIFFUSIVE AND ABSORPTIVE PROPERTIES AND PROCESS OF DESIGN

BACKGROUND OF THE INVENTION

When designing room acoustics for audio production or reproduction, a key decision is the forms of treatment for the boundaries, whether absorptive or diffusive. Diffusion has been shown to be useful in treating a wide variety of spaces such as studios and concert halls. It is possible to design diffusers from rigid surfaces; any absorption in the room is then provided by separate elements. Alternatively, it is possible in one hybrid surface, not only to partially absorb the sound, but ensure that the reflected energy is diffused. Some commercial examples of such surfaces are available; they comprise a complex array of absorbent and reflective patches, referred to as Abffusor® or Diffsorbor™, Trademarks of RPG Diffusor Systems, Inc., with the former referring to devices that primarily absorb scattered energy and with the latter referring to devices that primarily diffuse scattered energy. Combined diffusive-absorptive surfaces may be formed through any one of a plurality of approaches, including covering an absorptive surface with a perforated reflective mask and combining reflective and absorptive elements. Examples of a mask are shown in FIG. 1A and 1B, where the rectangular or circular holes, respectively, (which may be almost any shape) provide absorption and the other areas provide complete reflection. The impedance changes across the surface provide diffusion. These new hybrid surfaces offer the designer an increased choice between the extremes of completely absorbing or diffusing, which may suit applications in performance spaces.

Co-Applicant D'Antonio is the patentee of U.S. Pat. No. 5,817,992, issued Oct. 6, 1998, for PLANAR BINARY AMPLITUDE DIFFUSOR. The D'Antonio patent discloses a flat faced panel having alternating reflective and absorptive regions or patches defined by a binary sequence consisting of zeros and ones with a flat power spectrum with the sequence being determined based upon shift register theory. In the D'Antonio patent, there are substantially equal numbers of reflective and absorptive regions or patches, respectively. The D'Antonio patent fails to contemplate optimization of the pattern of absorptive and reflective patches obtained through operation of a genetic algorithm. Furthermore, the present invention distinguishes from the D'Antonio patent as contemplating a pattern of absorptive and reflective patches or regions wherein the ratio therebetween may be other than 1:1, depending upon whether the resultant diffusor must have greater reflective or absorptive properties based upon the particulars of the intended location of installation.

In addition, the present invention distinguishes from the D'Antonio patent as contemplating a surface which may comprise a simple or compound curve rather than being planar, thereby offering a greater degree of diffusion. These curved combined diffusive-absorptive surfaces may be designed using 1-dimensional (1D) or 2-dimensional (2D) optimized binary element sequences with varying degrees of reflectivity.

SUMMARY OF THE INVENTION

J. A. S. Angus investigated the use of binary amplitude sequences for forming partially absorptive, partially diffusive 1D surfaces, in a paper titled "Sound Diffusors Using Reactive Absorption Grating", published at the 98$^{th}$ Convention of the AES 43.390 (1995). The present invention relates to an alternative design regime for choosing an appropriate binary sequence to be used in designing an acoustical treatment having diffusive and absorptive properties. The present invention gives the designer control over the amount of absorption to provide, an aspect not readily achieved through prior art techniques. In the description set forth hereinbelow, a technique is explained which may be employed for forming an appropriate 1D or 2D binary sequence and testing the results on diffusers designed to scatter sound in one plane. Additionally, the present invention contemplates enhancing diffusion through introduction of a shallow optimized curve on acoustical treatment surfaces.

The present invention includes the following objects, aspects and features:

(1) In a first aspect, the present invention contemplates choice of an appropriate binary sequence which may be used to create an acoustical treatment surface having desired parts with reflective properties and desired parts having absorptive properties resulting in the net effect of partially diffusive, partially absorptive properties.

(2) Applicants have employed a genetic algorithm designed to search for optimal 1D and 2D configurations for the inventive acoustical treatments. A genetic algorithm essentially mimics the process of evolution that occurs in biology and is a known mathematical technique. However, Applicants are unaware of this technique being specifically applied to acoustical treatment surface design.

(3) During the course of genetic optimization, the fitness of individual sequences for the desired purposes is calculated. Applicants have found a useful fitness function including terms that optimize the desired percentage of reflectivity and absorptivity.

(4) To date, acoustical treatments having partially diffusive, partially absorptive surfaces have been flat, planar surfaces. Applicants have found that through use of these genetically optimized binary sequences (verified using a maximum length sequence and optimization techniques), a curved surface may be constructed and optimized to find the best shape to achieve even scattering. The curved surface produces a dramatic improvement in effectiveness of diffusion.

(5) As is known to those skilled in the art, there are no set rules for working out the values in genetic algorithms such as, for example, the number of individuals in each population, the percent of the population that dies and is replaced each generation, and the mutation rate. Accordingly, the skilled practitioner employs "trial and error". For example, if a genetic algorithm is tried, and the mutation rate is too high, the algorithm will never settle to a solution. If the mutation rate is, conversely, too low, the error space is not properly searched. Any skilled practitioner would, through "trial and error", play around with the different parameters of the algorithm seeking to obtain an optimal solution. In another aspect, the exact values chosen also depend upon the particular problem for which a solution is sought. If one is optimizing a longer sequence, then a larger population must be used.

(6) The present invention contemplates acoustic treatments with diffusive and absorptive properties that may be made in various sizes and configurations. In one preferred embodiment, such devices may be generally rectangular cubic having a volume defined by dimensions of length, width and depth. It is also contemplated to make such a device having a forward facing surface made up of a multiplicity of reflective or absorptive patches having shapes such as rectangular, circular, hexagonal or square. The present invention also contemplates providing the forward facing surface in an arcuate configuration. In essence, the present invention, in its broadest terms, contemplates an acoustical treatment having a prescribed volume with either a flat or arcuate forward facing surface, with the forward facing surface having any desired shape with the diffusive and absorptive properties thereof being determined through calculation of genetic algorithms and, thereby, genetic optimization as explained in detail hereinbelow.

Accordingly, it is a first object of the present invention to provide acoustical treatments with diffusive and absorptive properties.

It is a further object of the present invention to provide a process of designing such acoustical treatments.

It is a still further object of the present invention to provide acoustical treatments having either flat, simple or compound curved surfaces, with the curved surfaces dramatically enhancing diffusive properties.

It is a still further object of the present invention to provide these optimized diffusive-absorptive surfaces using a variety of embodiments including but not exclusive to a perforated reflective mask over a porous absorbing panel or a mixture of absorptive and reflective areas.

It is a still further object of the present invention to provide such an invention wherein the relationship between reflective and absorptive surfaces is optimized.

These and other objects, aspects and features of the present invention will be better understood from the following detailed description of the preferred embodiments when read in conjunction with the appended drawing figures.

BRIEF DESCRIPTION OF THE DRAWINGS

FIG. 1*a* shows rectangular openings while FIG. 1*b* shows circular openings.

SPECIFIC DESCRIPTION OF THE PREFERRED EMBODIMENTS

The design of the diffusive semi-absorptive acoustical treatments requires generation of an appropriate binary sequence to determine which parts of the diffusor will be reflective and which parts absorptive. The autocorrelation of the sequence is linked to the far field scattering produced by the surface. Accepting the usual assumptions behind simple Fourier-type prediction theories, the power spectrum of the mth diffraction lobe is given by:

$$|A_m|^2 = \sum_{k=0}^{p-1} c_k e^{-2\pi ikm/p} \tag{1}$$

Where the binary sequence is assumed to have a period of p, and c is the autocorrelation. This is given by:

$$c_m = \sum_{n=0}^{p-1} r_n r_{n+m}^* \tag{2}$$

Where r is the reflection coefficient of the surface. * indicates a complex conjugate. The reflection coefficient is assumed to be one (1) for a reflecting patch, and zero (0) for an absorbing patch. An assumption of reflection without phase change has been made.

To achieve diffraction lobes with similar scattering levels, one criterion for a good diffusor, a constant power spectrum is required. This can be achieved by using a binary sequence that produces a delta function autocorrelation coefficient. Such a sequence cannot be perfectly realized, and, accordingly, the optimum achievable sequence is one in which the side lobes of the autocorrelation coefficient are minimized. Sequences used in diffusor design, such as Barker Codes used in spread spectrum arrangements of Schroeder diffusers, are also based on this criterion of achievement of minimum side lobes in the autocorrelation coefficient.

In known mathematical sequences, there is insufficient control over the reflectivity of the surface since there may be no known sequence having the desired reflectivity. The solution to this problem is to conduct an iterative search for an appropriate sequence with two desired characteristics: (i) low autocorrelation side lobes and (ii) the appropriate reflectivity. This result can be achieved by employing a genetic algorithm.

Figure 1A:
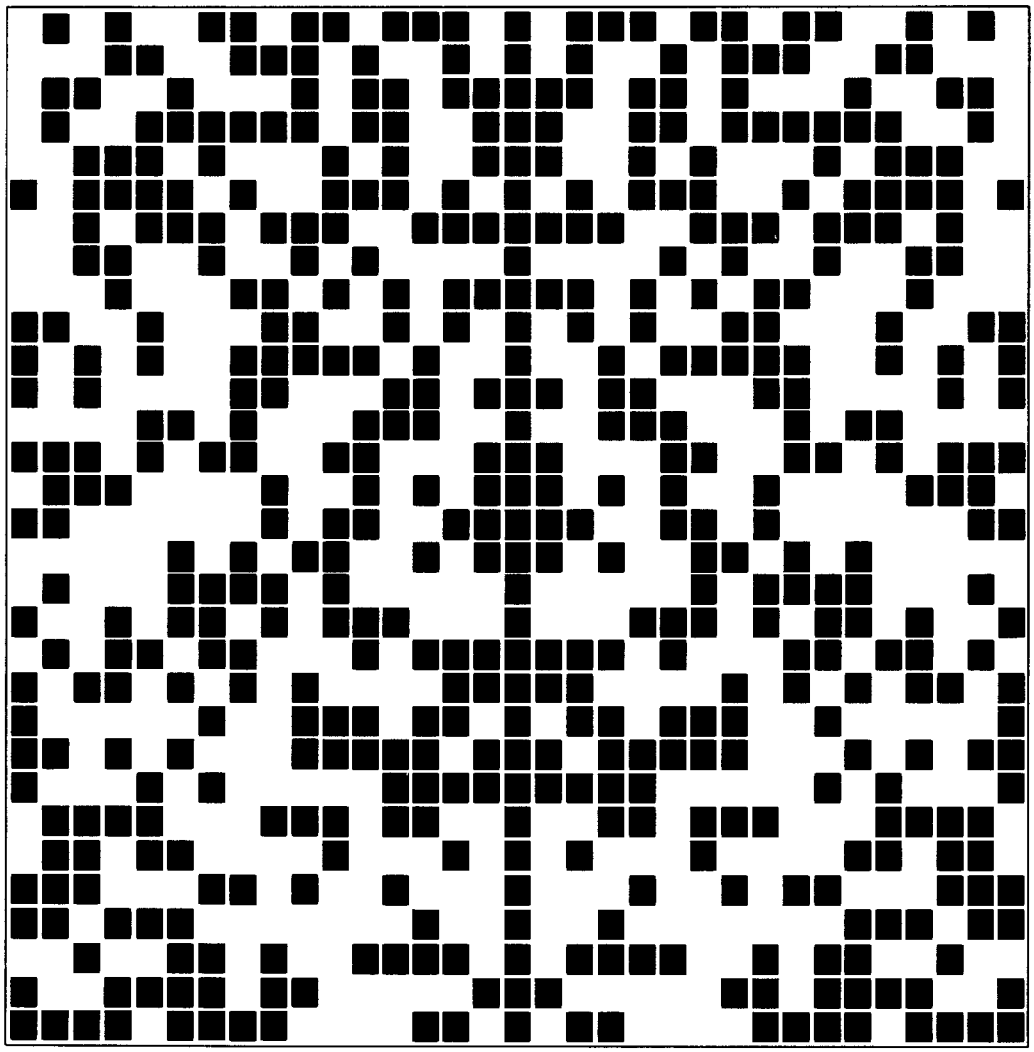
FIGS. 1*a* and 1*b* show schematic representations of masks used to form a partially diffusive, partially absorptive surface. Black areas represent openings to absorbing underlayment.
Figure 1B:
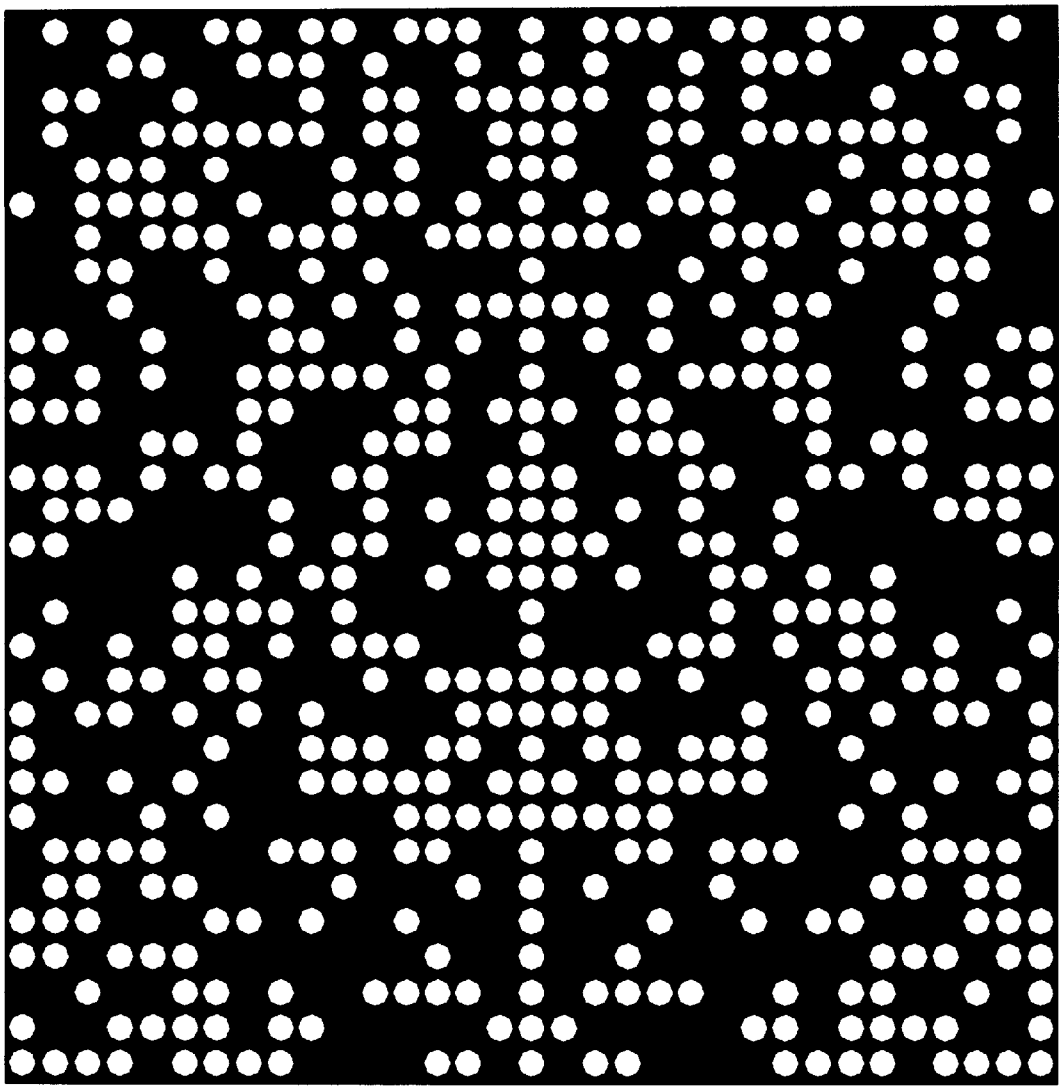
Figure 2:
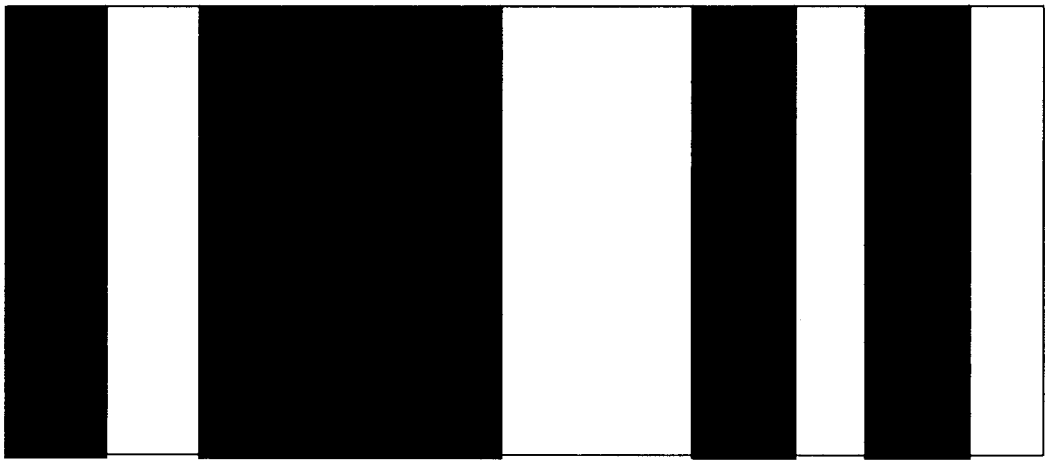
FIG. 2 shows a schematic representation of a single plane hybrid surface with the dark patches being absorptive and the white-colored patches being reflective.
Figure 3:
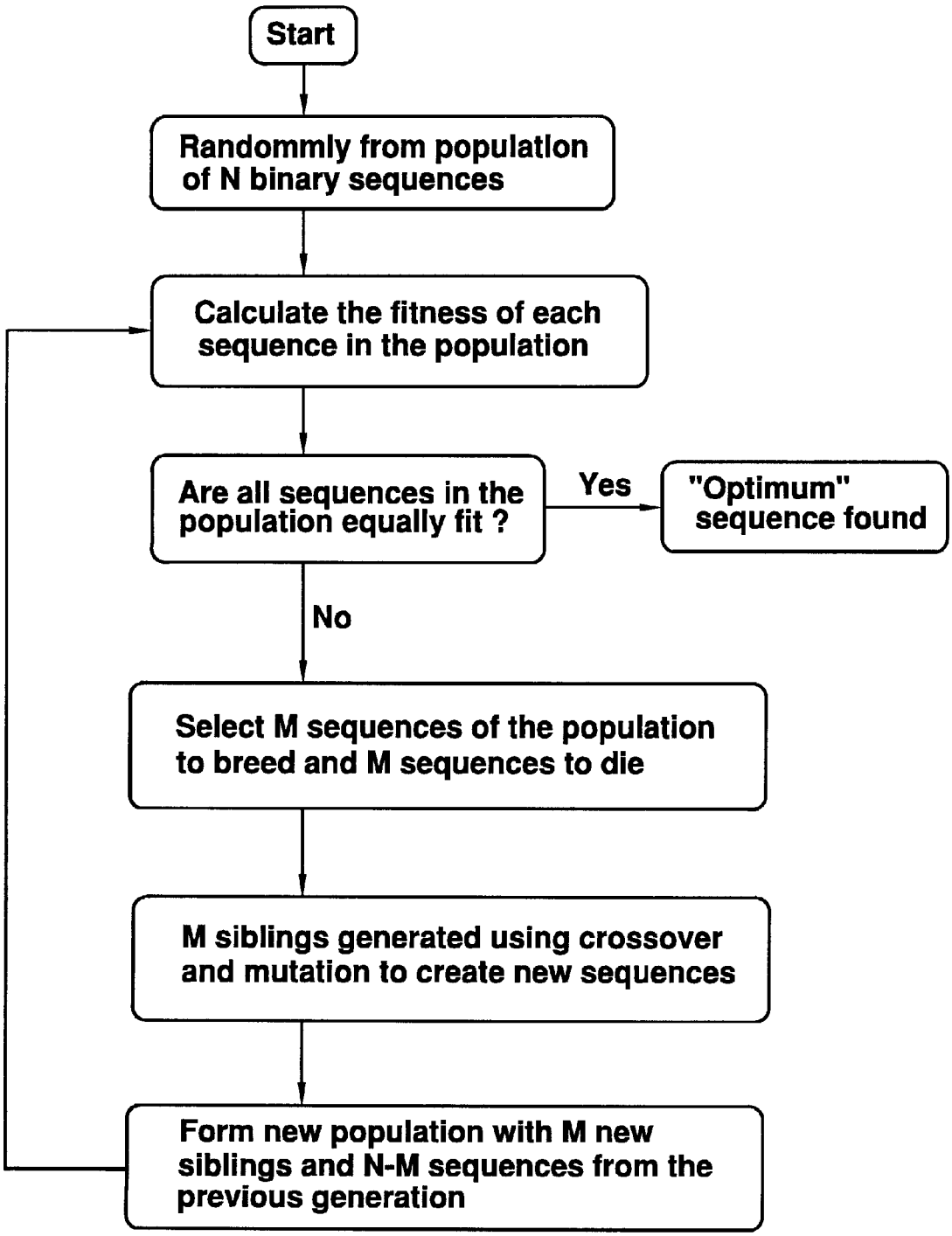
FIG. 3 shows a sequence for the process for generating a genetic algorithm.

A genetic algorithm is employed to search for optimum configurations in engineering problems. FIG. 3 illustrates, schematically, how a typical genetic algorithm works. Genetic algorithms are generally known, but Applicants are unaware of the prior application of genetic algorithms in design of acoustical treatments. The genetic algorithm essentially mimics the process of evolution that occurs in biology. A population of individuals is randomly formed. Each individual is determined by their genes, in this case the genes are simply the binary sequences indicating where hard and soft patches should be placed on the diffusor surface. Each individual has a fitness value that indicates how good they are at matching the criteria of appropriate reflectivity and minimum autocorrelation side lobes. Over time new populations are produced by breeding and old individuals die. Offspring are produced by pairs of parents. An offspring has a binary sequence that is a composite of the sequences from the parents. As with conventional evolution theory, the fittest are most likely to breed and pass on their genes, and the least fit, the most likely to die. Mutation can occur in the breeding to enable sequences outside the parent population to be searched. By these principles, the fitness of successive populations should improve. This process is continued until the population becomes sufficiently fit so that the sequence produced can be classified as optimum.

It is necessary to calculate the relative fitness of individual sequences. As explained above, the optimal fittest sequence could have a delta function autocorrelation and have exactly the desired percentage reflectivity. After some experimentation, a useful fitness function, $\epsilon$, was found by Applicants:

$$\varepsilon = \left[1 - \frac{\left(\sum_{m=1}^{p-1} c_m\right)^2}{n \sum_{m=1}^{p-1} c_m^2}\right] + \frac{1}{20}\left|\sum_{i=0}^{p-1} s_i - n_r\right| \tag{3}$$

Consider the right term first. $S_i$ is the binary sequence, where zero indicates an absorbing patch and one a reflecting area. $n_r$ is the desired number of reflective patches. Therefore, this term ensures fit members have the desired percentage reflectivity. The first term is monitoring the side lobes of the autocorrelation function, $c_m$, $m \neq 0$. This term is smallest when the side lobes of the autocorrelation all have the same value. This has the effect of disadvantaging sequences with significant peaks in the side lobes of the autocorrelation function. This may not be immediately apparent from the equation. This function has been developed to monitor the quality of scattering from surfaces. The scaling factor of 1/20 was found through a series of experimental trials. This scaling factor balances the relative importance of minimizing side lobes with achieving the correct reflectivity.

When "breeding", two "parent" sequences are randomly selected with fittest sequences being more likely to be chosen. The probability of the ith individual being selected for breeding was proportional to $\epsilon_i - \epsilon_{min}$ where $\epsilon_i$ is the fitness of the ith individual and $\epsilon_{min}$ is the lowest fitness value within the population. The two "parent" sequences then form one "child" by combining together the two "parent" sequences using multi-point crossover. In standard genetic algorithms, the term "crossover" describes how parent genes are combined together to form the child genes during breeding. An example follows:

PARENT 1 genes: ABCDEFGH

PARENT 2 genes: 12345678.

Single point crossover example: Find a random point in the gene chain and splice together—if the crossover point is between the $4^{th}$ and $5^{th}$ gene, an example of a child gene would be ABCD5678.

Two point crossover example: Find two points in the genes and splice together—if the crossover points are (1) between the numeral $4^{th}$ and $5^{th}$ gene and (2) between the $6^{th}$ and $7^{th}$ gene, an example of a child gene would be: ABCD56GH.

"Multiple point crossover" means that there is a variable number of crossovers. In such a case, any number from 0 to 8 is/are randomly selected.

For each bit in the sequence, there was a 50% chance of the "child's" bit coming from parent A and a 50% chance of the bit being from parent B. Mutation was also used. This is a random procedure whereby there is a small probability of any bit in the sequence flipping. When selecting sequences to die, this was also done randomly with the least fit sequences being most likely to be selected.

Sequences were generated using the genetic algorithm, and the results tested. This was done by forming diffusers and predicting the scattering using either a Boundary Element Model (BEM) or a solution based on assumed Kirchhoff boundary conditions. These concepts are explained in the following publications: T J Cox and Y W Lam, Evaluation of Methods for Predicting the Scattering from Simple Rigid Panels, Applied Acoustics, 40 123–140 (1993), and Predicting the Scattering from Reflectors and Diffusers using 2D Boundary Element Methods, J.Acoust.Soc.Am. 96(2). 874–878. (1994). The BEM model is successful in predicting the scattering from surfaces, and the Kirchhoff model, although less accurate, also yields reasonable predictions. The impedance of the absorbing patches was taken to be purely real, with absorption typical of one-inch fiberglass board (fiberboard). A 1.2 m wide panel was tested with the rear of the surface made completely absorbing. The binary sequence was 60 elements long, and hence each patch was 2 cm in size. The quality of diffusion from the surface was found by first calculating the far field polar distribution of the scattered energy for normal incidence sound. This polar distribution can then be turned into a diffusion coefficient. A normal incidence, pseudo-absorption coefficient $\alpha$ was found by considering the total energy over the polar distribution, $E_r$, and comparing that to the total energy scattered from a completely rigid surface, $E_t$. By definition:

$$\alpha = 1 - E_r/E_t \tag{4}$$

Figure 4:
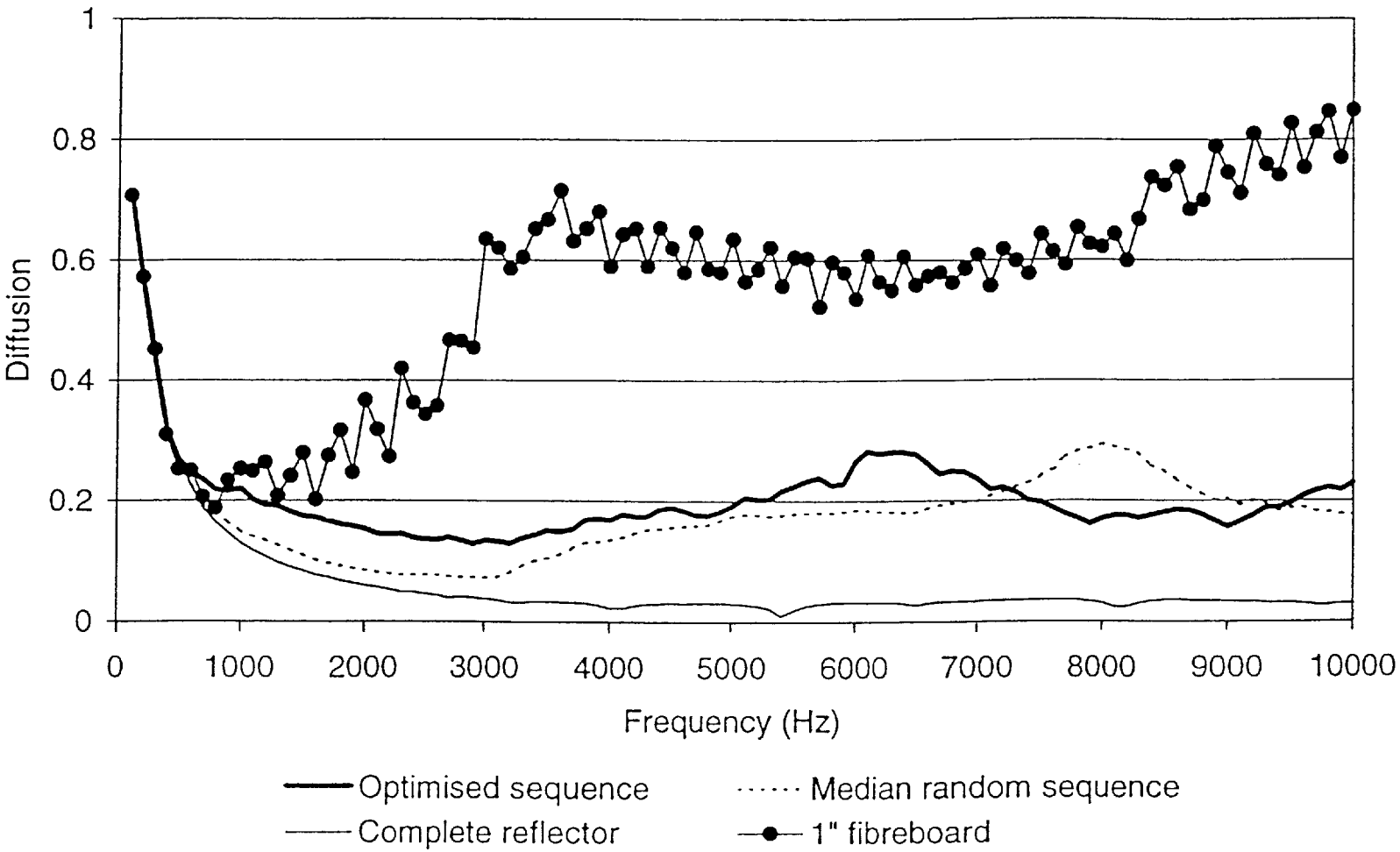
FIG. 4 shows a graph of diffusion versus frequency depicting the results obtained from two 50% reflectivity sequences as well as from a complete reflector and a one inch thick piece of fiberboard.
Figure 5:
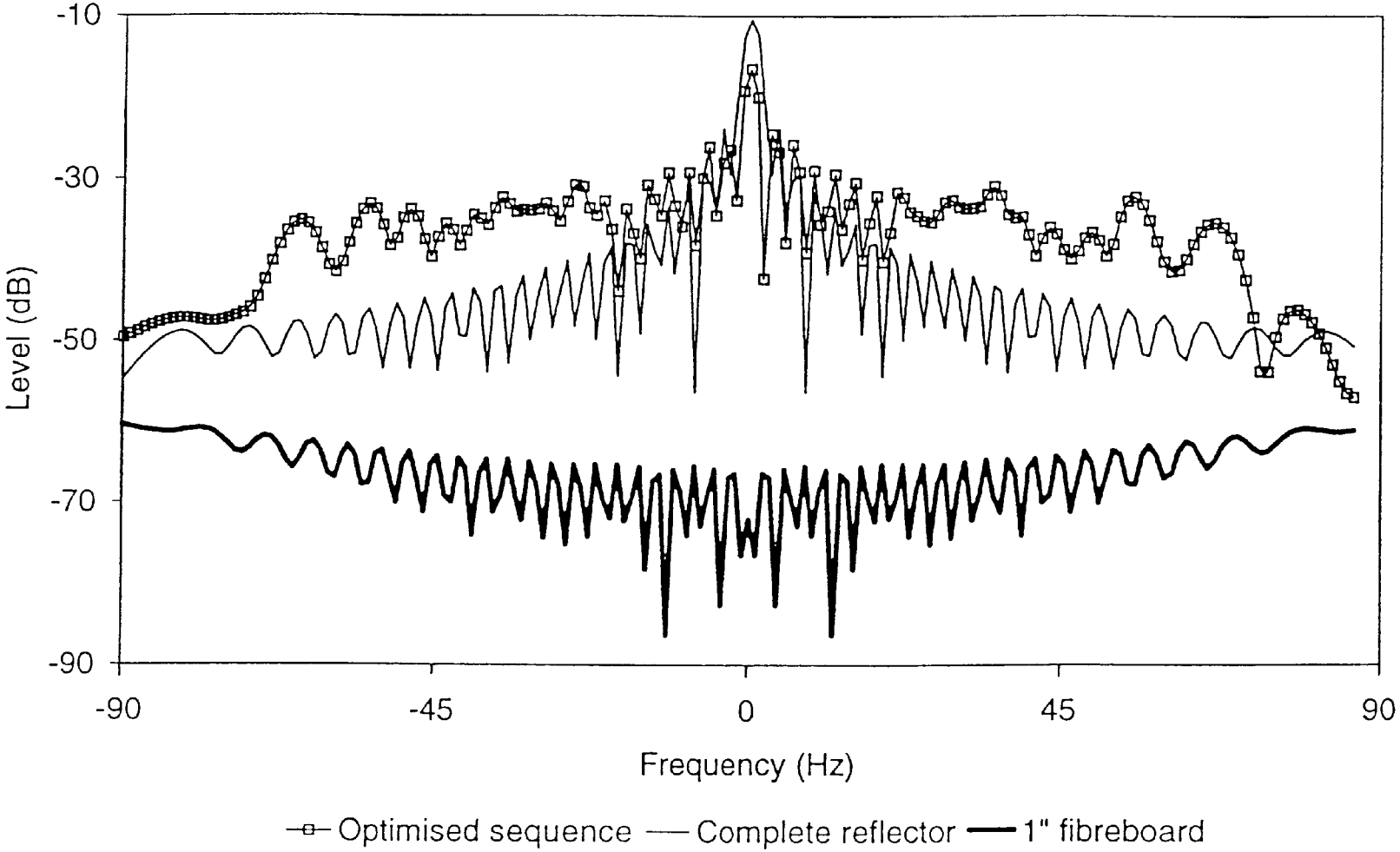
FIG. 5 shows a graph of level versus frequency of scattered polar response for an optimized sequence, a complete reflector and a one inch thick piece of fiberboard.
Figure 6:
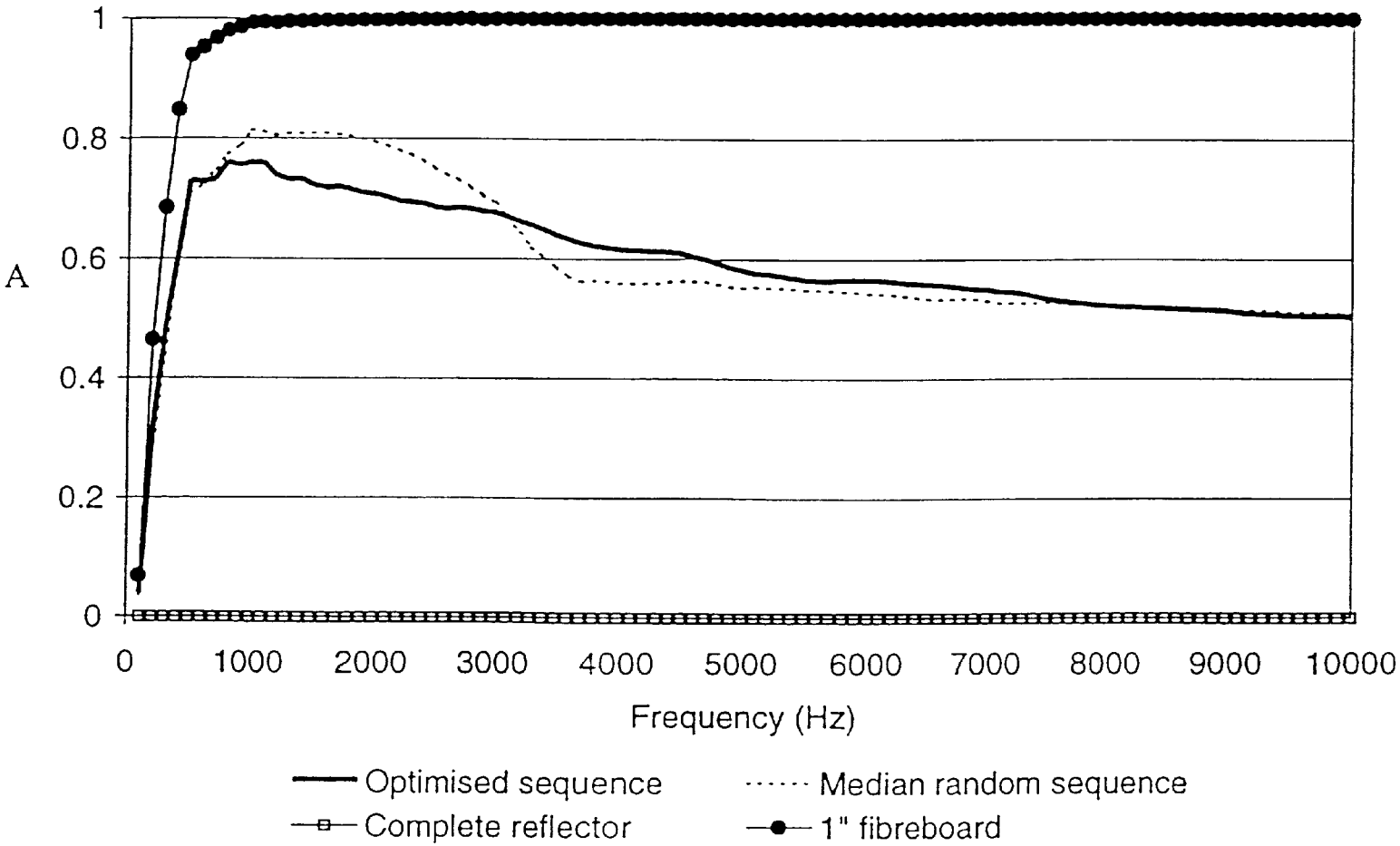
FIG. 6 shows a graph of normal incidence pseudo-absorption coefficient for various surfaces including that of an optimized sequence, a median random sequence, a complete reflector and a one inch thick piece of fiberboard.

FIG. 4 shows the diffusion from the 50% reflectivity case. For this diffusion measure, zero (0) represents poor diffusor and one (1) a good diffusor. It shows the complete reflector to be a poor scatterer, as expected, and the 1" fiberboard to be a good diffusor (although since the fiberboard reflects little or no energy, claiming this to be diffuse energy may miss the point). For the 50% reflectivity sequences, the optimized solution from the genetic algorithm is compared to a typical median random guess. The optimized sequence has better diffusion for many more frequencies than the random guess. The gains from optimization are not huge, but a definite improvement is seen. Importantly, the optimization has prevented the choice of poor solutions. FIG. 5 shows the polar distribution at a single frequency. The ability of the binary sequence to produce better diffusion is demonstrated.

Figure 7:
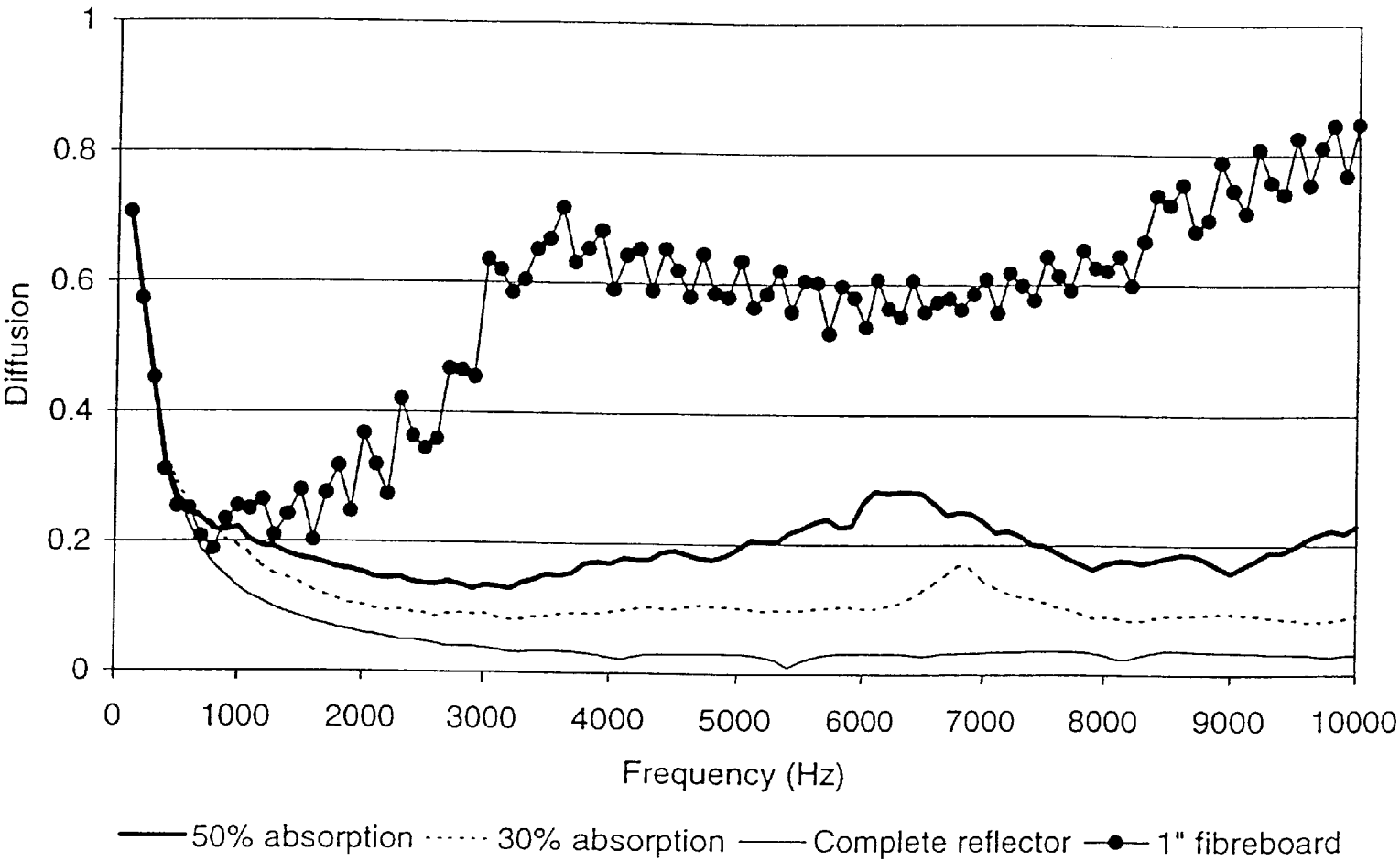
FIG. 7 shows a graph of diffusion versus frequency for various surfaces including a 50% absorptive surface, a 30% absorptive surface, a complete reflector and a one inch thick piece of fiberboard.

Of course, several existing mathematical sequences would achieve 50% reflectivity with low side lobe levels. The power of this design technique lies in enabling design at any desired reflectivity. FIG. 7 shows the diffusion from a 30% reflective surface. As might be expected, the diffusion produced is reduced as the reflectivity increases. The optimization process is still effective in finding a good diffusor within the reflectivity constraints imposed.

Figure 8:
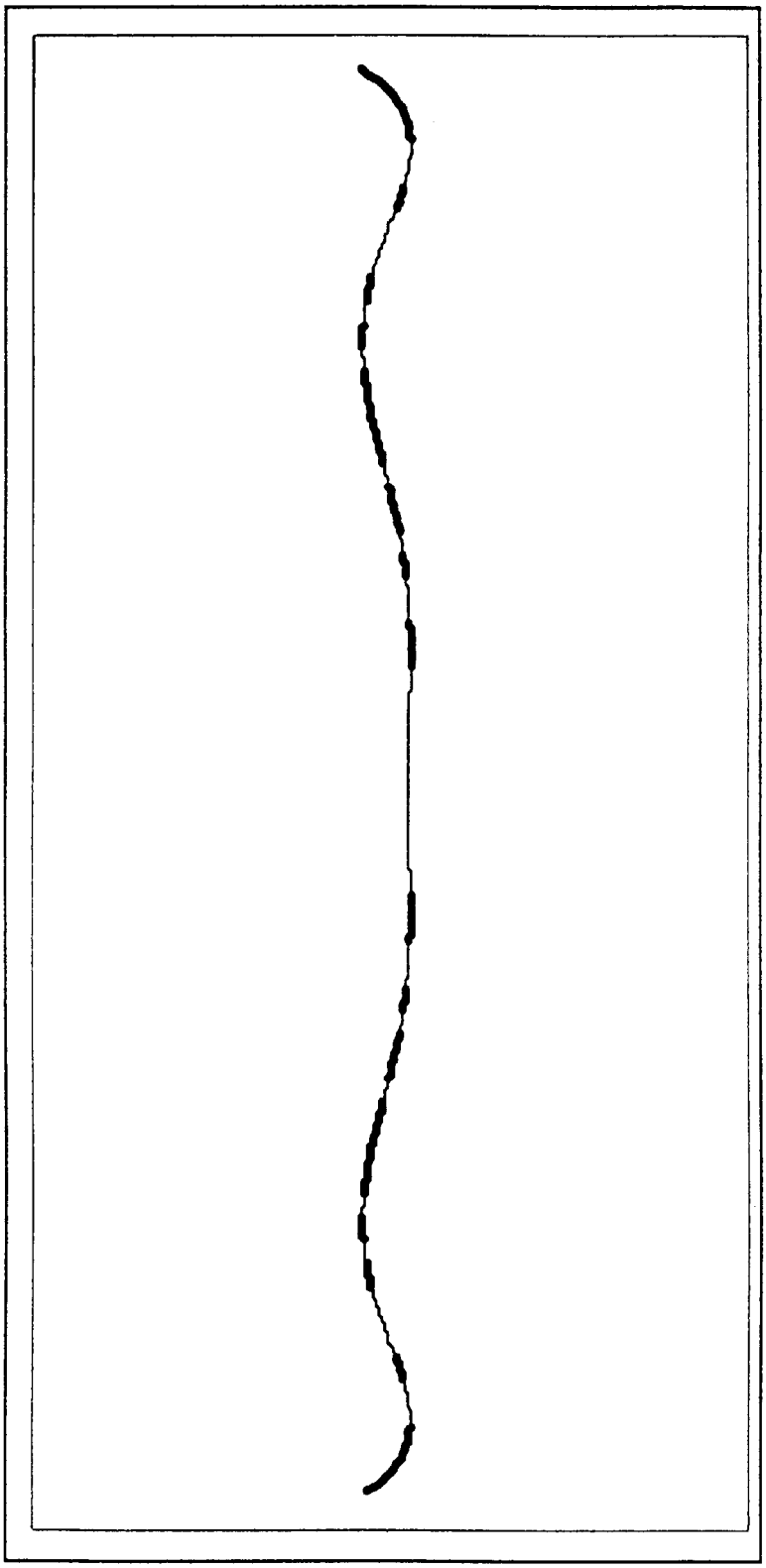
FIG. 8 shows a side profile of a curved hybrid surface.
Figure 9:
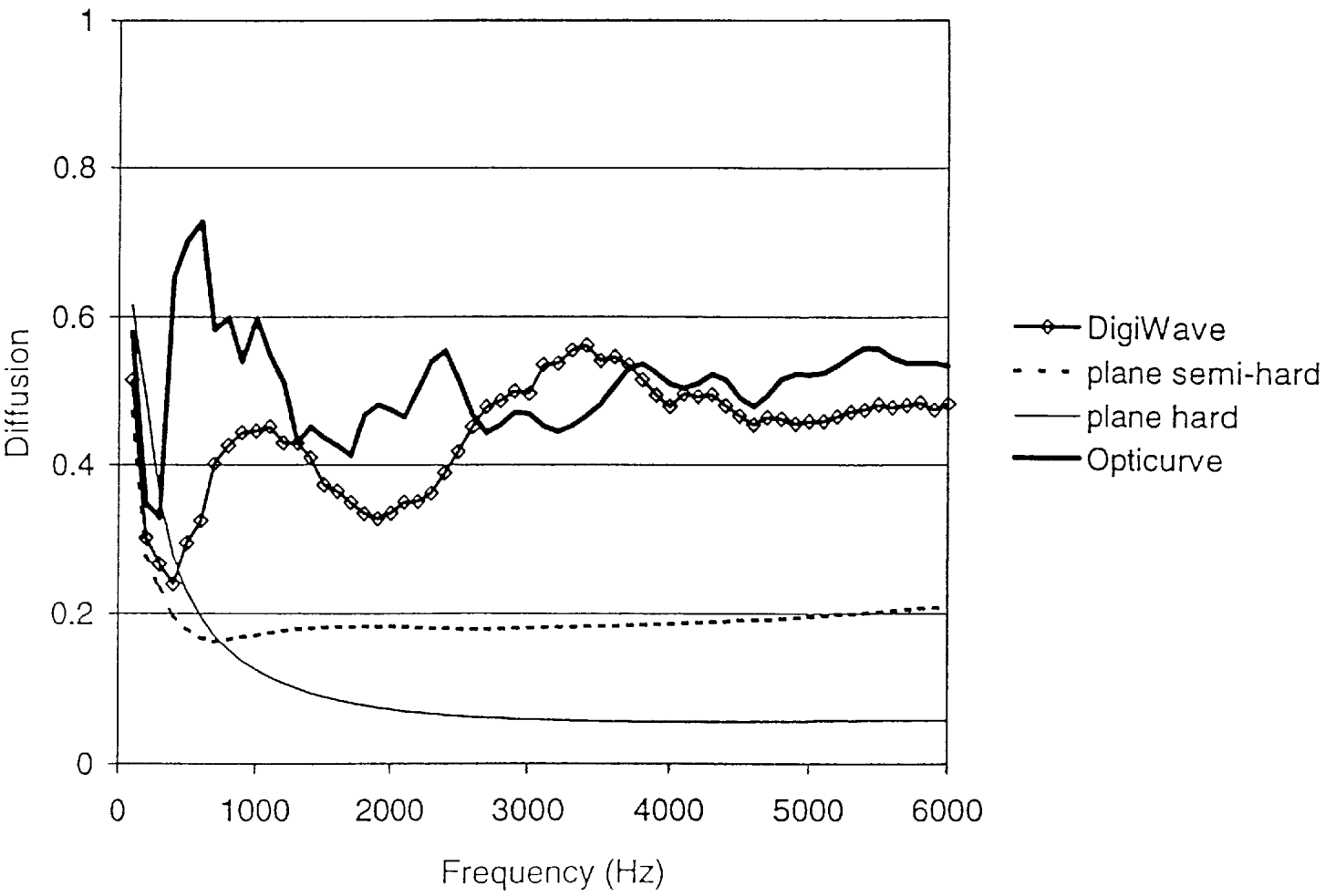
FIG. 9 shows a graph of diffusion versus frequency depicting the directional diffusion spectrum for four different surfaces, the curved hybrid surface of FIG. 8, as well as a plane semi-hard surface, a plane hard surface, and another curved surface.
Figure 10:
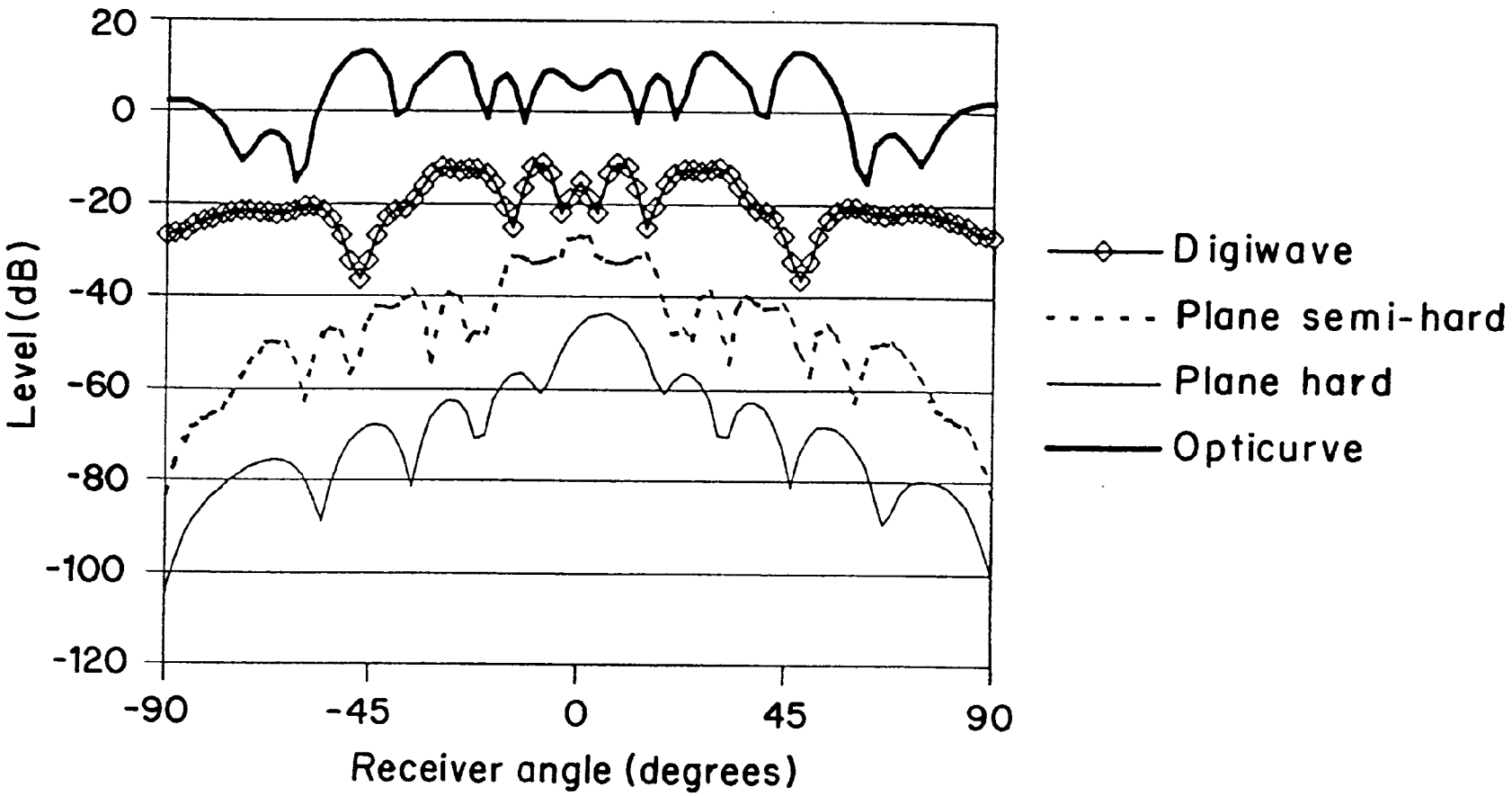
FIG. 10 shows a graph of level versus receiver angle for various surfaces including the curved hybrid surface of FIG. 8, a plane semi-hard surface, a plane hard surface, and a further curved surface.

Applicants have investigated the effect of curvature on acoustical performance of hybrid surfaces. A maximum length sequence was used. This binary sequence was then employed to construct a curved surface. The curved surface used was optimized to find the best shape to achieve even scattering. FIG. 8 shows the surface produced. The surface is only 7 cm deep, and is about 2.4 m wide. The scattering from the surface was predicted using the Kirchhoff solution technique. The diffusion is shown in FIG. 9 and the polar distribution for one example frequency in FIG. 10. For this comparison, four surfaces were predicted. A curved surface with a binary sequence of hard and soft patches results. The plane semi-hard surface is a flat diffusor based on the 31 maximum length sequence with hard and soft patches. The plane surface is a rigid surface of the same overall dimensions. The surface is a 30 cm deep optimized curved surface that is completely rigid. This last-mentioned surface is included because it is typical of rigid diffusers used in performance spaces and so is useful for comparison.

The diffusion spectrum shows that moving from a flat rigid surface to a semi-hard plane surface increases the diffusiveness of the scattered sound. Curving the semi-hard surface produces an even more dramatic improvement in diffusion. There is much to be gained from curving binary amplitude diffusers. Interestingly, the quality of diffusion for the curved surface with hard and soft patches is only slightly diminished in performance from the rigid curved surface, which is four times as deep. This indicates that a hybrid curved surface is effective in generating enhanced diffusion given a restricted depth, although it is only useful where some absorption is also desired.

Hybrid surfaces that are semi-absorbent and diffuse any scattered sound can be constructed from sequences of hard and soft materials. It has been shown that using a genetic algorithm enables optimum sequences to be found with good scattering characteristics. Importantly, the genetic algorithm enables design to a desired reflectivity. Further improvement in diffusion can be achieved by curving the surface. Even relatively shallow curves produce dramatic improvements in diffusion.

As such, an invention has been disclosed in terms of preferred embodiments thereof which fulfill each and every one of the objects of the invention as set forth hereinabove and provide new and useful acoustical treatments with diffusive and absorptive properties and process of design of great novelty and utility.

Of course, various changes, modifications and alterations in the teachings of the present invention may be contemplated without departing from the intended spirit and scope.

As such, it is intended that the present invention only be limited by the terms of the appended claims.

What is claimed is:

1. An acoustical device, comprising:

a) a body having a volume;

b) said body having a flat forward facing acoustical surface substantially defined by said length and width;

c) said acoustical surface having a plurality of discrete reflective regions and a plurality of discrete absorptive regions arranged in a pattern, said regions being arranged in accordance with a binary sequence optimized through operation of a genetic algorithm.

2. The device of claim 1, wherein said surface includes unequal numbers of reflective regions and absorptive regions.

3. The device of claim 1, wherein said body is square.

4. The device of claim 3, wherein said regions are generally rectangular.

5. The device of claim 1, wherein said regions are arranged in accordance with calculation of a binary sequence chosen after randomly forming a multiplicity of binary sequences, calculating fitness of each binary sequence, selecting a desired number of binary sequences to breed, selecting a desired number of binary sequences to die, and taking into account mutation.

6. The device of claim 5, wherein said pattern comprises an array comprising a plurality of said regions, said array having numbers of rows and columns defining a number of regions corresponding to said length of said binary sequence.

7. The device of claim 1, wherein said absorptive regions include a porous material having micro-pores or interstices that absorb sound.

8. An acoustical device, comprising:

a) a generally rectangular body having a length, a width and a depth;

b) said body having a curved forward facing acoustical surface substantially defined by said length and width;

c) said acoustical surface having a plurality of discrete reflective regions and a plurality of discrete absorptive regions arranged in a pattern, said regions being arranged in accordance with a binary sequence optimized through operation of a genetic algorithm.

9. The device of claim 8, wherein said surface includes unequal numbers of reflective regions and absorptive regions.

10. The device of claim 8, wherein said generally rectangular body is square.

11. The device of claim 8, wherein said regions are arranged in accordance with calculation of a binary sequence chosen after randomly forming a multiplicity of binary sequences, calculating fitness of each binary sequence, selecting a desired number of binary sequences to breed and selecting a desired number of binary sequences to die.

12. The device of claim 11, wherein said pattern comprises an array comprising a plurality of said regions, said array having numbers of rows and columns defining a number of regions corresponding to said length of said binary sequence.

13. The device of claim 8, wherein said absorptive regions include a porous material having micro-pores or interstices that absorb sound.

14. A method of making an acoustical device, including the steps of:

a) providing a body having a volume;

b) providing said body with a flat forward facing acoustical surface;

c) arranging, on said surface, a pattern consisting of a plurality of discrete reflective regions and a plurality of discrete absorptive regions arranged in accordance with a binary sequence optimized through operation of a genetic algorithm.

15. The method of claim 14, wherein said arranging step includes the steps of:

a) randomly forming a population of a multiplicity of binary sequences;

b) calculating fitness of each binary sequence in said population by applying fitness criteria;

c) according to said fitness criteria, choosing one set of binary sequences to breed and another set of binary sequences to die;

d) breeding said sequences in said one set by combining parent binary sequences and enabling new binary sequences to be altered by mutation.

16. The method of claim 14, wherein said second-mentioned providing step includes the step of providing said flat forward facing acoustical surface as a rectangle.

17. The method of claim 14, wherein said arranging step includes the step of arranging said pattern in an array comprising a number of rows of regions and a number of columns of regions.

18. The method of claim 17, wherein said arranging step further includes the step of making each absorptive or reflective patch of a shape chosen from the group consisting of rectangular, circular, hexagonal or square.

19. A method of making an acoustical device, including the steps of:

a) providing a body having a volume;

b) providing said body with a curved forward facing acoustical surface;

c) arranging, on said surface, a pattern consisting of a plurality of discrete reflective regions and a plurality of discrete absorptive regions arranged in accordance with a binary sequence optimized through operation of a genetic algorithm.

20. The method of claim 19, wherein said arranging step includes the steps of:

a) randomly forming a population of a multiplicity of binary sequences;

b) calculating fitness of each binary sequence in said population by applying fitness criteria;

c) according to said fitness criteria, choosing one set of binary sequences to breed and another set of binary sequences to die;

d) breeding said sequences in said one set by combining parent binary sequences and enabling new binary sequences to be altered by mutation.

21. The method of claim 19, wherein said arranging step includes the step of arranging said pattern in an array comprising a number of rows of regions and a number of columns of regions.

22. The method of claim 21, wherein said arranging step further includes the step of making each region generally rectangular.

23. A method of operating a genetic algorithm to optimize a forward facing surface of an acoustical treatment including the steps of:

a) randomly forming a population of a multiplicity of binary sequences;

b) calculating fitness of each binary sequence in said population by applying fitness criteria;

c) according to said fitness criteria, choosing one set of binary sequences to breed and another set of binary sequences to die;

d) breeding said sequences in said one set.

24. The method of claim 23, wherein said surface is flat.

25. The method of claim 23, wherein said surface is curved.

26. The method of claim 23, after said breeding steps, further including the steps of:

a) forming a new population from said breeding step;

b) calculating fitness of each sequence in the new population;

c) repeating steps b), c) and d) of claim 23 until an optimum binary sequence is found; and d) arranging reflective and absorptive regions on said surface in accordance with said optimum binary sequence.

* * * * *